US008257643B2

(12) United States Patent
Benedetti

(10) Patent No.: US 8,257,643 B2
(45) Date of Patent: Sep. 4, 2012

(54) TEMPERATURE MAINTENANCE AND/OR POSSIBLE HEATING APPARATUS FOR LONG METAL PRODUCTS AND RELATIVE METHOD

(75) Inventor: Gianpietro Benedetti, Tricesimo (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 12/858,816

(22) Filed: Aug. 18, 2010

(65) Prior Publication Data

US 2012/0018930 A1 Jan. 26, 2012

(30) Foreign Application Priority Data

Jul. 21, 2010 (IT) ..... UD2010A0149

(51) Int. Cl.
*C21D 1/00* (2006.01)
*B22D 29/00* (2006.01)

(52) U.S. Cl. ..... 266/103; 164/262

(58) Field of Classification Search ..... 164/262; 266/103

See application file for complete search history.

(56) References Cited

U.S. PATENT DOCUMENTS 6,783,612 B2 * 8/2004 Benedetti ..... 148/654
2009/0298001 A1 12/2009 Klein et al.

FOREIGN PATENT DOCUMENTS

EP 0 302 257 A1 2/1989
EP 0 353 487 A1 2/1990
EP 0 595 282 A1 5/1994
EP 0 665 296 A1 8/1995
EP 0 770 433 A1 5/1997
WO WO 00/71271 A1 11/2000
WO WO 2007/090455 A1 * 8/2007

* cited by examiner

*Primary Examiner* — Scott Kastler
(74) *Attorney, Agent, or Firm* — Hamre, Schumann, Mueller & Larson, P.C.

(57) ABSTRACT

A temperature maintenance and/or possible heating apparatus for long products, continuously cast and sheared to size by means of shearing means so as to define segments of bloom, said apparatus being disposed between a casting machine having a first casting line and a second casting line, and a rolling line disposed downstream of the casting machine in order to make long rolled metal products. The apparatus comprises a first furnace, a second furnace and a transit tunnel. The first furnace is provided with a first introduction rollerway. The second furnace is disposed upstream with respect to said first furnace, provided with a second introduction rollerway. The transit tunnel is located aligned with said first casting line, adjacent and parallel to the longitudinal extension of the second furnace and upstream of said first furnace.

3 Claims, 4 Drawing Sheets

TEMPERATURE MAINTENANCE AND/OR POSSIBLE HEATING APPARATUS FOR LONG METAL PRODUCTS AND RELATIVE METHOD

FIELD OF THE INVENTION

The present invention concerns a temperature maintenance and/or possible heating apparatus for continuously cast long products and the relative method, for a casting and continuous rolling plant in semi-endless mode, to make long metal rolled products such as bars, wire rod, beams, rails or sections in general.

BACKGROUND OF THE INVENTION

Continuous casting plants known in the state of the art for the production of long rolled products have considerable limitations in that, for reasons intrinsically connected to operating constraints and performance of the components, their productivity does not generally exceed 25-40 ton/h.

Consequently, in order to obtain higher productivity it is necessary to increase the number of casting lines connected to the same rolling line, which can be up to 8 lines or more.

This entails, among other things, the need to translate the billets or blooms exiting from the various casting lines on a single entrance point of the heating furnace, with the consequent losses of temperature during the transfers.

As a consequence of this consideration, a considerable quantity of energy is needed to feed the heating furnace, to restore the temperature lost and bring it from the entrance value, comprised between 650° C. and 750° C., to the value suitable for rolling, that is, in a range comprised between 1050° C. and 1200° C.

Moreover, the need to transfer the segments of billets or blooms from the various casting lines to the point where they are introduced into the furnace, imposes limitations on the length and therefore the weight: the length of the billets or blooms is comprised between 12 and 14 meters, up to a maximum of 16 meters, and the weight is on average equal to 2-3 tons.

These process necessities and limitations are the main cause of an increase in energy required for heating the billets or blooms, and of a worsening in achieving the maximum productivity, due both to the large-sized tundishes that are needed to serve several casting lines and also to the large number of billets or blooms to be processed given the same number of tons/hour to be produced, with consequent high number of crops, heads entrances into the stands of the mill and sub-lengths with non-commercial sizes.

To overcome this disadvantage, the number of casting lines has been reduced to two only, which has allowed to provide a suitable temperature maintenance and/or possible heating apparatus which receives the blooms from the two lines and renders them available to the rolling line located downstream.

One purpose of the present invention is therefore to devise a temperature maintenance and/or possible heating apparatus for continuously cast long metal products and a relative method associated with two casting lines which allows to manage in a simple and reliable manner the segments of cast product, sheared to size, without intermediate movements and/or transfers between the casting lines.

Another purpose of the present invention is to exploit to the utmost the enthalpy possessed by the original liquid steel along all the production line, and in particular inside the maintenance and possible heating apparatus, reducing temperature losses in the time between shearing the cast product to size and sending it to the rolling step, so as to obtain a considerable saving of energy and a reduction in the running costs compared to conventional processes.

Further purposes of the invention are:

to allow stoppages of the rolling mill without having to interrupt the casting process upstream, thus obtaining a high plant utilization factor;

to reduce to a minimum or eliminate the scrap material in emergency situations or during programmed stoppages and so completely recover the product which in these situations is temporarily accumulated inside the temperature maintenance and/or possible heating apparatus, thus allowing to obtain a higher yield, equal to the ratio between weight of the finished product and weight of the liquid steel to produce a ton.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe or variants to the main inventive idea.

A temperature maintenance and/or possible heating apparatus for long metal products according to the present invention is provided in a casting and continuous rolling plant of the semi-endless type for the production of long rolled products and is disposed between a continuous casting machine with two casting lines and a rolling line downstream.

The continuously cast metal products are sheared to size by shearing means disposed immediately downstream of the casting machine so as to define segments of bloom with a predefined length advantageously comprised between 16 and 60 m, preferably between 30 and 40 m.

The rolling line is disposed offset and parallel with respect to the casting lines.

Each casting line has a respective crystallizer which can cast products, in relation to thickness, at a variable speed from 3 to 9 m/min.

In the description and in the claims, by the term bloom we mean a product with a rectangular or square section in which the ratio between the long side and the short side is comprised between 1 and 4, that is, between the square section and the rectangular section in which the long side can be up to 4 times longer than the short side.

In the present invention the section of the cast product is not limited, as we said, to a quadrangular or rectangular section with straight and two by two parallel sides, but also comprises sections with at least a curved, concave or convex side, advantageously but not necessarily two by two opposite and specular, or combinations of the aforesaid geometries.

Simply to give an example, the square sections which are produced by each continuous casting line have dimensions which vary from about 100 mm×100 mm, 130 mm×130 mm, 150 mm×150 mm, 160 mm×160 mm or intermediate dimensions; in order to increase productivity, rectangular sections having dimensions which vary from 100 mm×140 mm, 130 mm×180 mm, 130 mm×210 mm, 140 mm×190 mm, 160 mm×210 mm, 160 mm×280 mm, 180 mm×300 mm, 200 mm×320 mm or intermediate dimensions can also be produced. In the case of the production of average profiles, even bigger dimensional sections can be used, for example of about 300 mm×400 mm and similar.

The maintenance and/or possible heating apparatus according to the present invention is located downstream from the casting machine; said segments of bloom, sheared to size, enter directly and without intermediate movements and/ or transfers into said apparatus at an average temperature of at least 1000° C., preferably comprised between about 1100° C. and about 1150° C. The average temperature at which the bloom exits from the apparatus is comprised between about 1050° C. and 1200° C.

According to a characteristic feature of the present invention, the temperature maintenance and/or possible heating apparatus comprises a first furnace, associated with the first casting line, a second furnace, disposed upstream of the first and associated with the second casting line, and a transit tunnel aligned with the first casting line, adjacent and disposed upstream of the first furnace.

In particular, the first furnace is provided with:

a first rollerway to introduce the bloom segments into the furnace, disposed aligned with a first casting line and from which it receives the bloom segments through the transit tunnel;

a removal rollerway, aligned with the rolling line, parallel and offset with respect to the first introduction rollerway and which renders the bloom segments available to the rolling line; and first transverse transfer devices to transfer the bloom segments from the first introduction rollerway to the removal rollerway.

In the same way, the second furnace, which is disposed upstream with respect to the first furnace, is provided with:

a second rollerway to introduce the bloom segments arriving from the second casting line, disposed aligned with the second casting line;

an exit rollerway, aligned with the removal rollerway, suitable to convey the bloom segments from the second furnace to the removal rollerway of the first furnace and subsequently to the rolling line; and second transverse transfer devices suitable to transfer the bloom segments from the second introduction rollerway to the exit rollerway.

The transit tunnel is disposed parallel to the longitudinal extension of the second furnace and upstream of said first furnace, and is conformed to transfer the bloom segments cast by the first casting line toward the first introduction rollerway of the first furnace so as to prevent any temperature loss of the bloom segment during its travel from the first casting line to the first furnace.

According to another feature of the invention, both the first and second furnace each comprise a buffer, or support plane or store zone, to temporarily contain the bloom segments arriving from the first and second introduction rollerways.

Each buffer is disposed between the introduction rollerways and the removal rollerway or respectively the exit rollerway of the respective furnaces.

According to another feature of the invention, the first and second transverse transfer devices comprise displacement means, which transfer the bloom segments from the introduction rollerways of the two furnaces toward the buffers that contain the blooms, and subsequent extraction means that extract the bloom segments from the containing buffers in order to render them available to the removal rollerway and/or the exit rollerway of the respective furnaces and thus render them available to the rolling line.

In particular, the bloom segments loaded onto the exit rollerway of the second furnace are conveyed through the removal rollerway of the first furnace to be subsequently sent to the rolling line.

The bloom segments loaded onto the removal rollerway of the first furnace are sent directly to the rolling line.

According to another feature of the present invention, the axes of the casting machine and of the rolling mill are offset and parallel with respect to each other, which is why this configuration is suitable to make a semi-endless type process.

Each furnace of the apparatus of the present invention is of a length that can vary at least from about 16 to about 60 meters, preferably from about 30 to about 40 meters.

The removal and exit rollerways respectively of the first and second furnace are aligned to the axis of the rolling mill, and operate at the rhythm of the rolling mill located downstream, so as to feed the bloom segments to the rolling mill downstream without solution of continuity.

In this way, when the plant is working under normal conditions, the continuous casting and the rolling can operate in a substantially continuous condition, approaching an "endless" mode condition, even though they are working with segments sheared to site and with a rolling line misaligned with respect to the two casting lines.

The buffers act as an accumulation store for the blooms, for example when it is necessary to overcome an interruption in the rolling process, due to accidents or for a programmed roll-change or for change of production, in this way avoiding any losses of material and energy and, above all, avoiding any interruption of the casting. The maintenance and/or possible heating apparatus allows to accumulate blooms for a time that can even reach up to 60/80 minutes (at maximum casting speed) and more, and is in any case variable during the design of the plant.

This allows to considerably improve the plant utilization factor.

Thanks to the accumulation capacity of the two furnaces, the overall yield is also improved for the following reasons:

the number of casting re-starts is reduced or eliminated, with consequent saving of waste material at start and end of casting;

steel which at the moment of an accidental blockage in the rolling mill, for example due to a cobbles, is to be found from the tundish (which unloads the liquid steel into the crystallizer) to the beginning of the rolling mill does not have to be scrapped, nor the steel remaining in the ladle, which often cannot be recovered;

in the event of an accidental blockage of the rolling mill, the bloom already gripped in one or more stands can be returned inside the furnace and kept there, also at temperature, preventing any segmentation and therefore any loss of material.

According to one formulation of the present invention, the optimum length of the bloom segments, and hence of the furnaces that have to contain them, is chosen as a function of the reduction to a minimum of the linear combination of the heat losses in the furnaces and the losses of material due to crops, short bars and cobbles.

The present invention also concerns a method in which the continuous casting step is made in two casting lines; the cast products are sheared to size and conveyed respectively in the introduction rollerways of the two furnaces of the maintenance and/or possible heating apparatus; the bloom segments are subsequently translated into the buffers of the respective furnaces for the maintenance and/or possible heating step which provides to maintain at temperature and/or possibly heat a plurality of bloom segments for a time correlated to the size in length and width of the furnaces, and determined to optimize the operating connection between continuous casting and rolling.

The method also provides that the maintenance and/or possible heating apparatus during the stoppages of the rolling mill acts as an accumulation store between casting and rolling for a time that can be determined during the design stage and which can vary from 30 to 80 minutes or more, at maximum casting speed.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
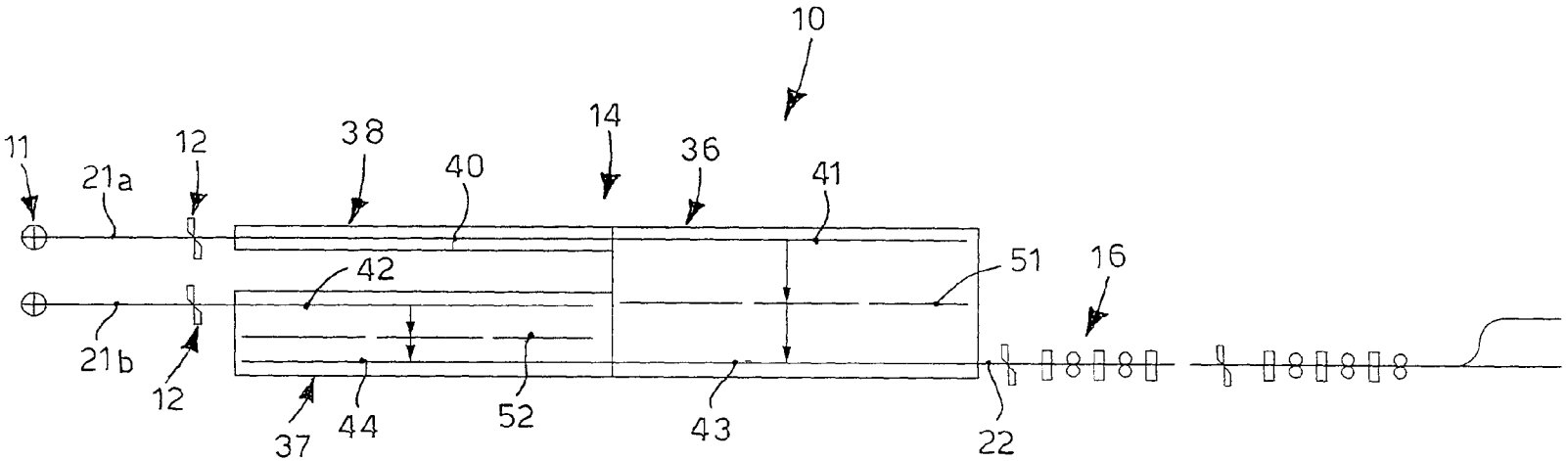
FIG. 1 shows a possible lay-out of a rolling plant into which the temperature maintenance and/or possible heating apparatus according to the present invention is inserted.
Figure 3:
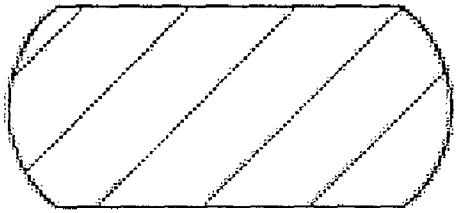
FIGS. 2-5 show examples of some different sections that can be cast with the plant in FIG. 1.

With reference to the attached drawings, FIG. 1 shows a first example of a lay-out 10 of a plant for the production of long products according to the present invention, into which a temperature maintenance and/or possible heating apparatus 14 according to the present invention is inserted.

Figure 5:
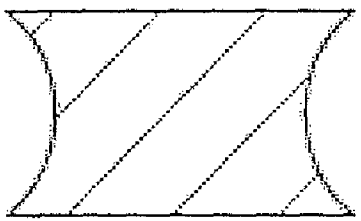
Figure 2:
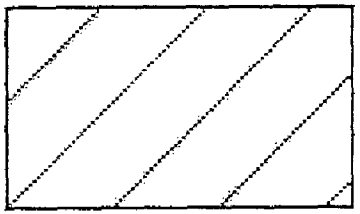
Figure 4:
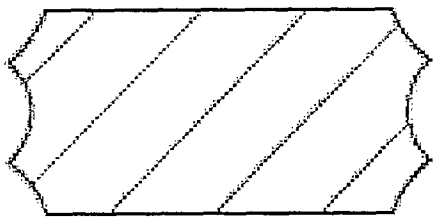

The lay-out 10 in FIG. 1 comprises, in the essential elements shown, a continuous casting machine 11 comprising two casting lines, respectively the first line 21*a* and the second line 21*b*, which develop parallel to each other, each of which uses a crystallizer or other device suitable to cast blooms with a square or rectangular section and of various shapes and sizes, with straight, curved, concave or convex sides, or other. Some examples of sections that can be cast with the present invention are shown in FIGS. 2-5, which show respectively a rectangular section with straight and parallel sides (FIG. 2), a section with short sides with a convex curvature and straight and parallel long sides (FIG. 3), a section with short sides having a convex curvature at the center and with straight and parallel long sides (FIG. 4) and a section with short sides with a concave curvature and straight and parallel long sides (FIG. 5).

It is quite evident that the same considerations can also be made for blooms with a square section.

The two casting lines 21*a* and 21*b* (FIG. 1) are disposed on lines offset but parallel with respect to a single rolling line 22, they cast two blooms in parallel, preferably with the same section, square or rectangular, and both feed a single rolling mill 16 located downstream.

Downstream of each casting line 21*a*, 21*b* there are means for shearing to size 12, for example a shears or an oxy cutting torch, which shear the cast blooms into segments of a desired length. Advantageously, the blooms are cut into segments of a length from 1 to 5 times more than that in the state of the art and, according to the present invention, the length is comprised between 16 and 60 meters or more, preferably between 30 and 40 meters. In this way blooms of a great weight are obtained, from 5 to 15 times higher than in the state of the art which, according to the present invention, is comprised between 10 and 50 ton.

In this way, although the lay-out is configured as operating in semi-endless mode, in that it starts from segments sheared to size, the bloom segments of great length and great linear weight allow, during normal working conditions, to operate in a condition of substantial continuity, obtaining a performance very close to that of the endless mode.

The apparatus 14 is located downstream of the continuous casting machine 11 and immediately after the shearing to site means 12, and comprises a first furnace 36, a second furnace 37 disposed upstream of the first furnace 36, and a transit tunnel 38 adjacent to the second furnace 37.

The product cast by the first casting line 21*a*, after being sheared to size by the shearing means 12, is conveyed to the first furnace 36 through the transit tunnel 38.

The product cast by the second casting line 21*b*, on the contrary, is conveyed directly to the second furnace 37, also after being sheared to size by the shearing means 12.

The transit tunnel 38 is disposed parallel to the longitudinal extension of the second furnace 37 and, by means of an internal rollerway 40, allows to transfer the segment of bloom cast by the first casting line 21*a* toward the first furnace 36.

The transit tunnel 38 is suitably insulated to reduce to a minimum the losses of heat energy of the bloom segments in transit.

The first furnace 36 comprises a first introduction rollerway 41 which is disposed aligned with the internal rollerway 40 of the transit tunnel 38 and hence with the first casting line 21*a*, and a removal rollerway 43 which provides to transfer the bloom segments contained in the first furnace 36 toward the rolling line 22. The removal rollerway 43 is aligned with the rolling line 22, so that the bloom segments exiting from the first furnace 36 go to feed the rolling mill 16 downstream.

In the same way, the second furnace 37 comprises a second introduction rollerway 42 aligned with the second casting line 21*b* and an exit rollerway 44 which transfers the bloom segments to the removal rollerway 43.

Advantageously, the two casting lines 21*a*, 21*b* feed the bloom segments directly into the first and second furnace 36, 37, without intermediate movements and/or transfers, along the respective casting lines 21*a*, 21*b* and at an average temperature of at least 1000° C., preferably comprised between about 1100° C. and about 1150° C. The average temperature at which the bloom leaves the apparatus 14 is instead comprised between about 1050° C. and 1200° C.

Figure 6:
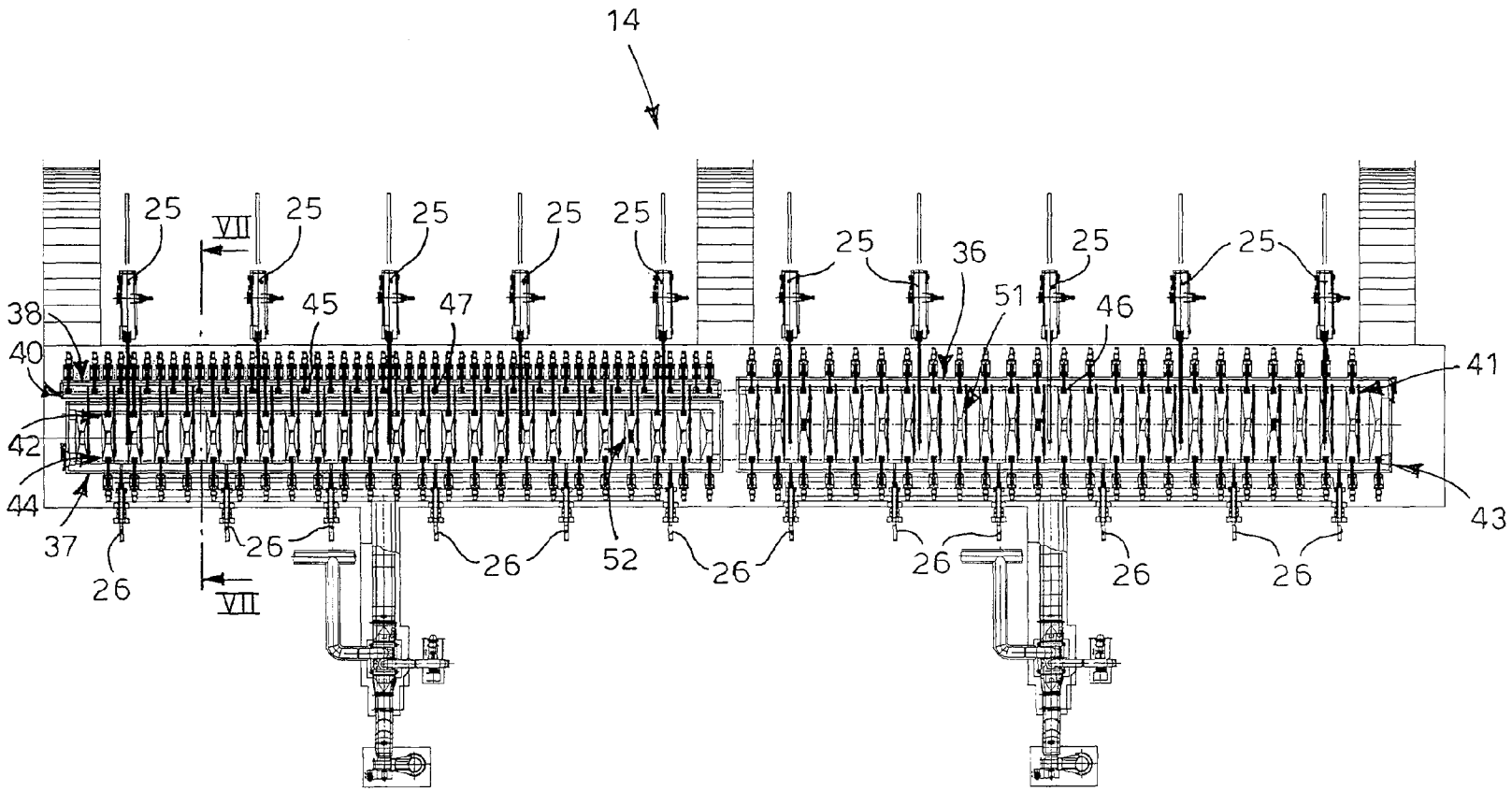
FIG. 6 shows a plane view of the maintenance and/or possible heating apparatus according to the present invention.
Figure 7:
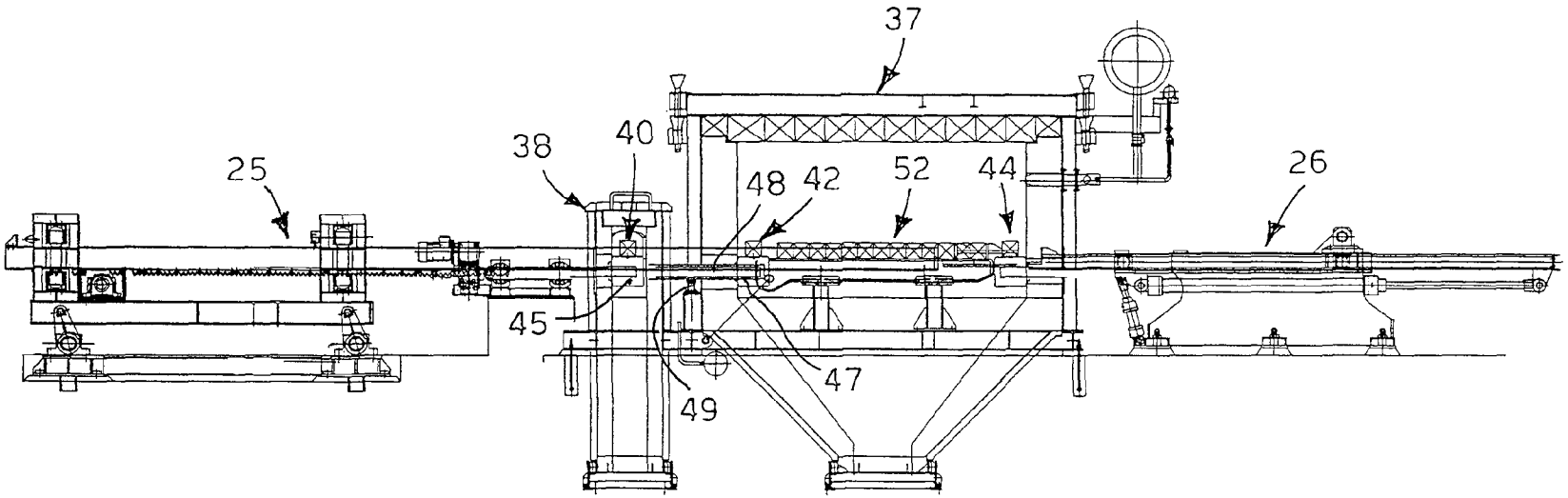
FIG. 7 shows a lateral section view of FIG. 6 from VII to VII.

With reference to FIGS. 6 and 7, the internal rollerway 40, the second introduction rollerway 42 and the first introduction rollerway 41 are each provided with their own motorized drawing rollers 45, respectively 46 and respectively 47.

The motorized drawing rollers 45, 46, 47 are mounted cantilevered on watercooled shafts, and made to rotate by motor members disposed outside the furnaces 36, 37 and the transit tunnel 38.

In particular, the motorized drawing rollers 47 of the second introduction rollerway 42 are mounted on transmission shafts 48 which extend through the transit tunnel 38 and are mounted on two supports 49. One of the supports 49 is disposed between the transit tunnel 38 and the second furnace 37 and allows to reduce the cantilevered extension and hence the flexional stresses to which the shafts are subjected.

In the same way, the removal rollerway 43 and the exit rollerway 44 are also provided with respective motorized drawing rollers which are disposed along a single axis of feed aligned with the rolling line 22.

Both the first furnace 36 and the second furnace 37 each comprise a buffer 51, respectively 52, or support plane or store zone, on which the bloom segments are temporarily disposed, arriving respectively from the first and second introduction rollerway 41 and 42.

Inside the first and second furnace 36, 37 the necessary lateral connection is also achieved between the first 41 and the second introduction rollerway 42 and the removal rollerway 43 and the exit rollerway 44. To this purpose, both the first furnace 36 and the second furnace 37 comprise displacement means 25 to transfer the bloom segments from the first 41 and/or the second introduction rollerway 42 to the buffers 51 and 52 and extraction means 26 to pick up the bloom segments present in the buffers 51 and 52 and load them respectively on the first removal rollerway 43 and on the exit rollerway 44.

The positioning of the bloom segments inside the buffers 51, 52 depends on the particular operating condition of the plant. If the buffer 51, 52 is free, the bloom segments are positioned in the terminal zone thereof, adjacent to the respective removal rollerway 43 and/or the exit rollerway 44, while if there are other bloom segments already present on the buffer 51, 52, or if the rolling mill has a productivity lower than that of the casting, or if the rolling line 22 is stopped for some reason, then the new bloom segments arriving are put in a queue after those already accumulated and subsequently all of the buffered blooms are thrust together by said displacement means toward the out position.

In another embodiment, the movement of the blooms placed on the buffer could be realized, instead of the above mentioned displacement means, with a plurality of longitudinal walking beams, which are provided with movement mechanisms.

Given the particular conformation of the apparatus 14, due substantially to the presence of the transit tunnel 38 adjacent and parallel to the second furnace 37, the latter has a lower containing capacity than the first furnace 36.

To give an example, the buffer 51 of the first furnace 36 has a capacity of about twelve/thirteen bloom segments whereas the buffer 52 of the second furnace 37 has a capacity of about ten segments.

The displacement means 25 operate at the same rhythm as the respective casting lines 21*a* and 21*b*, whereas the extraction means 26 of each furnace 36, 37 operate at the rhythm dictated by the rolling line 22 downstream.

Each furnace 36, 37 not only creates the lateral connection between the two casting lines 21*a* and 21*b* and the rolling line 22, but also has the following functions and works with the following modes:

it functions as a chamber only to maintain the bloom segments at temperature. In this configuration the chamber guarantees that the temperature is maintained between entrance and exit;

it functions as a heating furnace for the bloom segments. In this configuration the first furnace 36 and the second furnace 37 raise the temperature of the load between entrance and exit; in this case, the first furnace 36 has about four or five useful positions for heating and maintaining the temperature of the bloom segments, while the second furnace 37 has three such positions.

The apparatus 14 also functions as a lateral transfer store which can compensate the different productivities of the continuous casting machine 11 and the rolling mill 16 located downstream.

Furthermore, if there is an interruption in the functioning of the rolling mill 16, due to accidents or for a programmed roll-change or for change of production, the transfer means 25 continue to accumulate inside the furnaces 36 and 37 the bloom segments arriving from the two casting lines 21*a*, 21*b* until the respective buffers 51 and 52 are full, whereas the extraction means 26 remain still.

The buffers 51, 52 therefore allow to overcome the stoppages of the rolling mill, offering the possibility of accumulating bloom segments for a time varying up to 60/80 minutes, without needing to stop or slow down the continuous casting machine 11.

In the same way it is possible to provide, due to the need to reduce productivity, to make only one casting line function, and therefore only one furnace instead of both, without needing to stop the whole plant.

The optimum length of the bloom segments cast by each casting line 21*a* and 21*b*, and hence the optimum length of the furnaces 36 and 37 that will have to contain the bloom segments, is chosen according to the reduction to the minimum of the linear combination of the heat losses inside them and the losses of material due to crops, short bars and cobbles.

Since the optimum length of the bloom segment is calculated as a function of the consumption parameters of the furnaces 36 and 37 which are directly connected to its length, it is also valid to determine the optimum length of each furnace 36, 37. In fact, each furnace 36, 37 will have an optimum length at least equal to that of the bloom segments, except that advantageously a safety margin is provided which takes into account possible bloom segments sheared out of tolerance, and also the necessary dimensional and constructional adaptations.

In this way, the optimum operating conditions for the coordination of the continuous casting machine and the rolling mill are identified.

The optimized length of the bloom segment, according to the present invention, is about 30-40 m and can also reach 60 meters, that is, considerably more, also in weight, than the corresponding values of bloom segment known in machines with several casting lines.

It is also possible to increase the yield of the cast product thanks to the reduced loss of material due to crops along the rolling mill 16 and thanks to the elimination of short bars.

The lay-out 10 can in any case provide for other devices such as for example units to reduce the section of the rolled product immediately upstream or downstream of the maintenance apparatus 14, or heating inductors to take the temperature of the bloom segments to values suitable for rolling.

The invention claimed is:

1. A temperature maintenance and/or possible heating apparatus for long products, continuously cast and sheared to size by means of shearing means so as to define segments of bloom, said apparatus being disposed between a casting machine having a first casting line and a second casting line, and a rolling line disposed downstream of the casting machine in order to make long rolled metal products, the apparatus comprising:

a first furnace provided with a first introduction rollerway to introduce the bloom segments, disposed aligned with said first casting line, a removal rollerway, aligned with said rolling line and suitable to render the bloom segments available to said rolling line, and transverse transfer devices to transfer the bloom segments from the first introduction rollerway to the removal rollerway;

a second furnace disposed upstream with respect to said first furnace, provided with a second introduction rollerway to introduce the bloom segments, disposed aligned with said second casting line, an exit rollerway aligned with the removal rollerway and suitable to convey the bloom segments toward said removal rollerway and transverse transfer devices suitable to transfer the bloom segments from the second introduction rollerway toward the exit rollerway;

a transit tunnel located aligned with said first casting line, adjacent and parallel to the longitudinal extension of the second furnace and upstream of said first furnace, and having an internal rollerway to transport the cast bloom segments from said first casting line toward the first introduction rollerway of the first furnace, wherein the transit tunnel includes insulation for reducing loss of energy of the bloom segments in transit, wherein the second furnace has a lower containing capacity than the first furnace, the first furnace has a capacity of about twelve/thirteen bloom segments, and the second furnace has a capacity of about ten bloom segments, wherein each of said internal rollerway, first introduction rollerway and second introduction rollerway comprising motorized drawing rollers mounted cantilever on water-cooled shafts and made to rotate by motor members disposed outside the furnaces and the transit tunnel, wherein the motorized drawing rollers of the second introduction rollerway are mounted on transmission shafts which extend through the transit tunnel and are mounted on at least two supports, wherein one of the supports is disposed between the transit tunnel and the second furnace to reduce the cantilevered extension and the flexional stresses to which the shafts are subjected.

2. The temperature maintenance and/or possible heating apparatus as in claim 1, wherein said first furnace and said second furnace each comprise a respective buffer, disposed between the first introduction rollerway, respectively the second introduction rollerway, and the removal rollerway, respectively the exit rollerway, so as to temporarily contain bloom segments coming from said first casting line and from said second casting line.

3. The temperature maintenance and/or possible heating apparatus as in claim 2, wherein said transverse transfer devices comprise displacement means suitable to transfer the bloom segments from said first introduction line and/or second introduction line toward said buffer, and extraction means suitable to selectively extract from said buffers one of said bloom segments in order to dispose them on said removal rollerway and/or on said exit rollerway.

* * * * *